US010872718B2

(12) United States Patent
Hamano et al.

(10) Patent No.: US 10,872,718 B2
(45) Date of Patent: Dec. 22, 2020

(54) COIL COMPONENT

(71) Applicant: Murata Manufacturing Co., Ltd., Kyoto-fu (JP)

(72) Inventors: Morihiro Hamano, Nagaokakyo (JP); Keiichi Tsuduki, Nagaokakyo (JP); Kouhei Matsuura, Nagaokakyo (JP); Minoru Matsunaga, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 216 days.

(21) Appl. No.: 16/028,717

(22) Filed: Jul. 6, 2018

(65) Prior Publication Data

US 2019/0013130 A1 Jan. 10, 2019

(30) Foreign Application Priority Data

Jul. 10, 2017 (JP) ..... 2017-134362

(51) Int. Cl.
*H01F 5/00* (2006.01)
*H01F 5/06* (2006.01)
(Continued)

(52) U.S. Cl.
CPC ..... *H01F 5/06* (2013.01); *H01F 3/10* (2013.01); *H01F 5/04* (2013.01); *H01F 17/0013* (2013.01);
(Continued)

(58) Field of Classification Search
CPC ... H01F 5/04; H01F 5/06; H01F 27/28; H01F 27/29; H01F 27/32; H01F 27/40;
(Continued)

(56) References Cited

U.S. PATENT DOCUMENTS 6,169,470 B1 1/2001 Ibata et al.
6,285,273 B1 * 9/2001 Morikawa ..... H01P 5/10 333/26
(Continued)

FOREIGN PATENT DOCUMENTS

CN 1130735 C 12/2003
CN 103262187 A 8/2013
(Continued)

OTHER PUBLICATIONS

An Office Action; "Notification of Reasons for Refusal," dated by the Japanese Patent Office on Sep. 17, 2019, which corresponds to Japanese Patent Application No. 2017-134362 and is related to U.S. Appl. No. 16/028,717; with English language translation.

*Primary Examiner* — Shawki S Ismail
*Assistant Examiner* — Lisa N Homza
(74) *Attorney, Agent, or Firm* — Studebaker & Brackett PC

(57) ABSTRACT

A coil component includes a first magnetic body, an insulator stacked on the first magnetic body, a second magnetic body stacked on the insulator, a coil which is disposed in the insulator and which includes at least one coil conductor layer, and an internal magnetic body disposed within the inner circumference of the coil and connected to the first magnetic body and the second magnetic body. In a cross section in a stacking direction, the width of the internal magnetic body increases continuously from the first magnetic body side toward the second magnetic body side. Also, the inner circumferential surface of an end coil conductor layer located closest to the second magnetic body faces the outer circumferential surface of the internal magnetic body and is inclined in the same direction as the outer circumferential surface of the internal magnetic body with respect to the stacking direction.

20 Claims, 5 Drawing Sheets

(51) Int. Cl.

| | |
|---|---|
| ***H01F 27/32*** | (2006.01) |
| ***H01F 5/04*** | (2006.01) |
| ***H01F 17/00*** | (2006.01) |
| ***H01F 17/04*** | (2006.01) |
| ***H01F 3/10*** | (2006.01) |
| *H01F 27/29* | (2006.01) |

(52) U.S. Cl.
CPC ..... *H01F 17/0033* (2013.01); *H01F 17/04* (2013.01); *H01F 27/32* (2013.01); *H01F 27/292* (2013.01)

(58) Field of Classification Search
CPC ..... H01F 27/245; H01F 7/0013; H01F 2027/2809; H03H 7/01
USPC ..... 335/299
See application file for complete search history.

(56) References Cited

U.S. PATENT DOCUMENTS 6,628,189 B2 * 9/2003 Yazaki ..... H01F 17/0013 333/25
6,903,643 B2 * 6/2005 Lee ..... H01F 17/0013 333/25
7,439,842 B2 * 10/2008 Fujiki ..... H01F 17/0006 333/25
7,898,362 B2 * 3/2011 Miyata ..... H01F 17/0013 333/175
2004/0070468 A1 * 4/2004 Harada ..... H01P 1/23 333/185
2004/0070768 A1 * 4/2004 McDaniel ..... G02B 26/001 356/519
2007/0199734 A1 * 8/2007 Kudo ..... H01F 41/041 174/255
2007/0205856 A1 * 9/2007 Matsunaga ..... H01F 17/0013 336/200
2008/0130258 A1 * 6/2008 Kudo ..... H01F 27/292 361/811
2009/0121806 A1 * 5/2009 Sasaki ..... H03H 7/1758 333/174
2013/0293216 A1 11/2013 Yokoyama et al.
2014/0176283 A1 6/2014 Yang et al.
2014/0347773 A1 * 11/2014 Park ..... H02H 9/005 361/56
2016/0099102 A1 * 4/2016 Matsunaga ..... H01F 27/402 336/105
2016/0218691 A1 7/2016 Park et al.
2017/0063322 A1 * 3/2017 Matsunaga ..... H03H 7/427
2017/0092413 A1 * 3/2017 Matsunaga ..... H01F 27/292
2017/0294257 A1 * 10/2017 Omori ..... H03H 7/09
2018/0122563 A1 * 5/2018 Matsuura ..... H01B 1/02
2018/0350499 A1 * 12/2018 Matsuura ..... H03H 7/0115
2019/0013130 A1 * 1/2019 Hamano ..... H01F 5/06
2019/0164676 A1 * 5/2019 Tsuduki ..... H01F 17/04
2019/0164677 A1 * 5/2019 Matsuura ..... H01F 41/046
2019/0206612 A1 * 7/2019 Tsuduki ..... H01F 27/2804
2020/0152365 A1 * 5/2020 Matsuura ..... H01F 17/0013

FOREIGN PATENT DOCUMENTS

| | | | |
|---|---|---|---|
| JP | H09260162 | A | 10/1997 |
| JP | H09275014 | A | 10/1997 |
| JP | 2013042040 | A | 2/2013 |
| JP | 2014127718 | A | 7/2014 |
| JP | 2016096259 | A | 5/2016 |
| JP | 2016139783 | A | 8/2016 |
| JP | 2016-213333 | A | 12/2016 |
| WO | 2012111203 | A1 | 8/2012 |
| WO | 2013183452 | A1 | 12/2013 |

* cited by examiner

COIL COMPONENT

CROSS-REFERENCE TO RELATED APPLICATION

This application claims benefit of priority to Japanese Patent Application No. 2017-134362, filed Jul. 10, 2017, the entire content of which is incorporated herein by reference.

BACKGROUND

Technical Field

The present disclosure relates to a coil component.

Background Art

An existing coil component is described in Japanese Unexamined Patent Application Publication No. 2016-213333. The coil component includes a first magnetic body, an insulator stacked on the first magnetic body, a second magnetic body stacked on the insulator, a coil which is disposed in the insulator and which includes two coil conductor layers, and an internal magnetic body which is disposed within the inner circumference of the coil in the insulator and which is connected to the first magnetic body and the second magnetic body. In a cross section in the stacking direction of the first magnetic body, the insulator, and the second magnetic body, the width of the internal magnetic body increases continuously from the first magnetic body side toward the second magnetic body side.

When the coil component in the related art is produced and used, cracks may occur in the insulator.

SUMMARY

Accordingly, the present disclosure provides a coil component in which the occurrence of cracks in the insulator can be suppressed.

According to preferred embodiments of the present disclosure, a coil component includes a first magnetic body, an insulator stacked on the first magnetic body, a second magnetic body stacked on the insulator, a coil which is disposed in the insulator and which includes at least one coil conductor layer, and an internal magnetic body which is disposed within the inner circumference of the coil in the insulator and which is connected to the first magnetic body and the second magnetic body. In a cross section in the stacking direction of the first magnetic body, the insulator, and the second magnetic body, the width of the internal magnetic body increases continuously from the first magnetic body side toward the second magnetic body side. The inner circumferential surface of an end coil conductor layer located closest to the second magnetic body, in the coil, faces the outer circumferential surface of the internal magnetic body and is inclined in the same direction as the outer circumferential surface of the internal magnetic body with respect to the stacking direction.

In the coil component according to preferred embodiments of the present disclosure, the inner circumferential surface of the end coil conductor layer faces the outer circumferential surface of the internal magnetic body and is inclined in the same direction as the outer circumferential surface of the internal magnetic body with respect to the stacking direction. Therefore, the inner circumferential surface of the end coil conductor layer can be set away from the outer circumferential surface of the internal magnetic body compared with the case where the inner circumferential surface of the end coil conductor layer is parallel to the stacking direction. Consequently, when a hole is formed from the second magnetic body side toward the first magnetic body side in the insulator so as to be filled with the internal magnetic body, stress concentration on the insulator around the inner circumferential surface of the end coil conductor layer can be reduced, and the occurrence of cracks in the insulator can be suppressed.

In an embodiment of the coil component, in a cross section in the stacking direction, the shape of the end coil conductor layer is substantially polygonal and has round vertices. According to this embodiment, stress concentration on the insulator around the vertices of the end coil conductor layer can be reduced, and the occurrence of cracks in the insulator can be suppressed.

In an embodiment of the coil component, the shape of the end coil conductor layer is substantially triangular and protrudes toward the second magnetic body. According to this embodiment, delamination between insulating layers that interpose the coil conductor layer can be suppressed.

In an embodiment of the coil component, the first magnetic body, the internal magnetic body, and the second magnetic body are composed of Ni—Cu—Zn-based ferrite, and the insulator is composed of glass containing borosilicate glass. According to this embodiment, the first magnetic body, the internal magnetic body, and the second magnetic body are composed of Ni—Cu—Zn-based ferrite, and thereby, favorable high-frequency impedance characteristics can be provided. The insulator is composed of glass containing borosilicate glass and, thereby, the dielectric constant can be decreased, the stray capacitance of the coil can be reduced, and favorable high-frequency characteristics can be provided.

In an embodiment of the coil component, the end surface of the internal magnetic body that faces the second magnetic body is substantially circular and has a diameter of about 200 μm or less, and in a cross section in the stacking direction, the angle formed by the end surface and the outer circumferential surface of the internal magnetic body is about 45 degrees or more and 70 degrees or less (i.e., from about 45 degrees to 70 degrees). According to this embodiment, the diameter of the end surface of the internal magnetic body is about 200 μm or less. In addition, the angle formed by the end surface and the outer circumferential surface of the internal magnetic body is about 45 degrees or more and 70 degrees or less (i.e., from about 45 degrees to 70 degrees). Therefore, the volume of the internal magnetic body is ensured, high impedance is gained, and the coil can be arranged in the inner part of the insulator so as to increase the number of turns of the coil.

In an embodiment of the coil component, in a cross section in the stacking direction, the inner circumferential surface of the end coil conductor layer is parallel to the outer circumferential surface of the internal magnetic body. According to this embodiment, the inner circumferential surface of the end coil conductor layer is parallel to the outer circumferential surface of the internal magnetic body. Therefore, the inner circumferential surface of the end coil conductor layer can be reliably set away from the outer circumferential surface of the internal magnetic body, and the occurrence of cracks in the insulator can be suppressed.

In an embodiment of the coil component, the first magnetic body has a recessed portion connected to the internal magnetic body. According to this embodiment, the internal magnetic body is in contact with the recessed portion of the first magnetic body. Therefore, the contact area between the first magnetic body and the internal magnetic body can be increased. Consequently, a magnetic path can be reliably ensured, high impedance is gained, and variations in the impedance can be reduced.

In an embodiment of the coil component, a gap is present in at least part of the interface between the internal magnetic body and the insulator. According to this embodiment, a gap is present in at least part of the interface between the internal magnetic body and the insulator. Therefore, even when there is a difference in the thermal expansion coefficient between the internal magnetic body and the insulator, stress applied from the internal magnetic body to the insulator after firing can be reduced, and the occurrence of cracks in the insulator can be suppressed. In addition, a reduction in magnetic permeability (magnetostriction) of the internal magnetic body is suppressed, and high impedance can be gained.

In an embodiment of the coil component, in a cross section in the stacking direction, the minimal distance between the inner circumferential surface of the end coil conductor layer and the outer circumferential surface of the internal magnetic body is about 100 μm or more. According to this embodiment, the inner circumferential surface of the end coil conductor layer is closest, in the coil, to the outer circumferential surface of the internal magnetic body. Consequently, the thickness of the insulator in this portion is the smallest in the insulator, and the strength itself against the stress is reduced. The minimal distance between the inner circumferential surface of the end coil conductor layer and the outer circumferential surface of the internal magnetic body is about 100 μm or more and, therefore, the insulator can ensure strength sufficient for enduring thermal stress during baking of outer electrodes and mounting.

Other features, elements, characteristics and advantages of the present disclosure will become more apparent from the following detailed description of preferred embodiments of the present disclosure with reference to the attached drawings.

DETAILED DESCRIPTION

Figure 1:
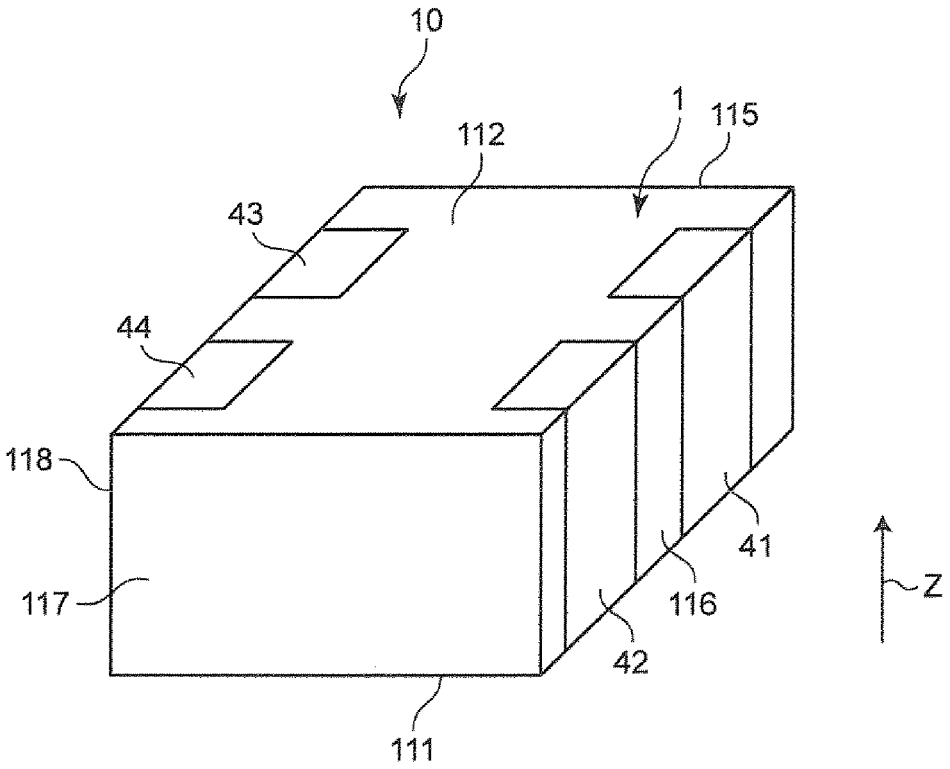
FIG. 1 is a perspective view showing a coil component according to a first embodiment of the present disclosure.

As described above, regarding the coil component in the related art, cracks may occur in the insulator. The present inventors intensively investigated this phenomenon and, as a result, found a cause, as described below.

When an internal magnetic body is formed in an insulator, a hole is formed within the inner circumference of a coil in the insulator by a laser or the like, and the resulting hole is filled with the internal magnetic body. At this time, the hole is formed in the insulator from the second magnetic body side toward the first magnetic body side and, thereby, the area of a second-magnetic-body-side opening increases. However, if the opening area of the hole is excessively large, fine cracks may occur in the insulator around the coil conductor layer. Then, the cracks may further develop because the thermal expansion coefficient of the coil conductor layer and the thermal expansion coefficient of the insulator are different from each other, and, thereby, stress is applied to the insulator around the coil conductor layer due to thermal stress during production and mounting.

As a result of intensive investigations, in a cross section in the stacking direction, the coil conductor layer located closest to the second magnetic body is substantially rectangular, and a crack that starts from the second-magnetic-body-side vertex of the inner circumferential surface of the coil conductor layer occurs in the insulator. That is, the second-magnetic-body-side vertex of the inner circumferential surface of the coil conductor layer approaches the inner surface of the hole of the insulator, and, thereby, stress is concentrated on the insulator around the vertex during processing of the hole and a crack occurs.

One of the present embodiments was realized based on the above-described original finding by the present inventors. The present disclosure will be described below in detail with reference to the embodiments shown in the drawings.

First Embodiment

Figure 2:
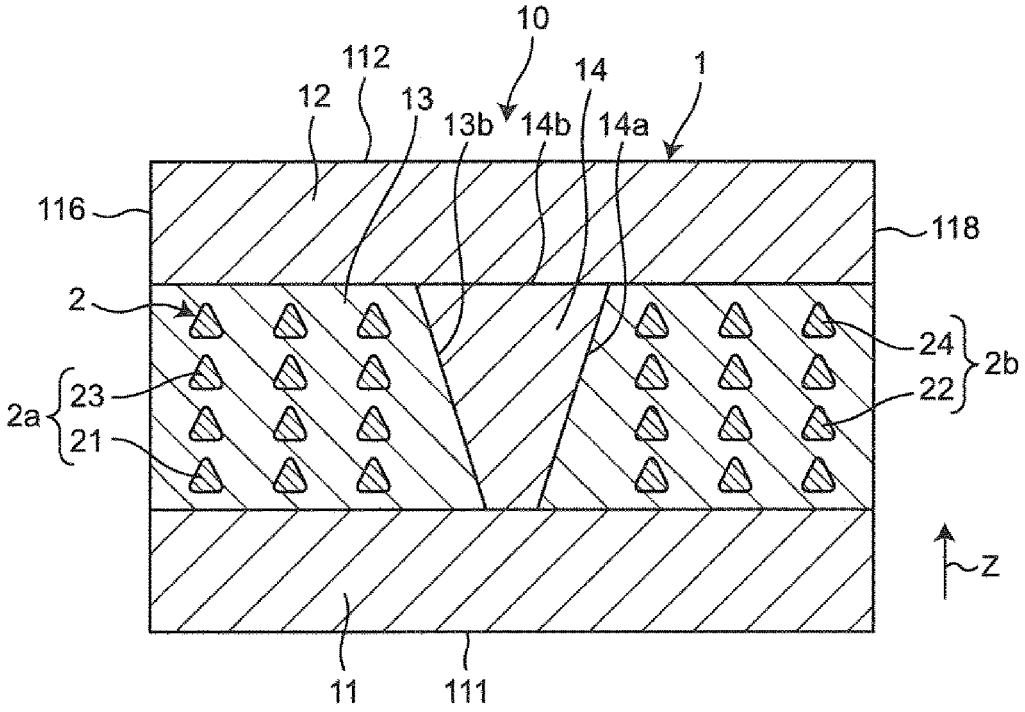
FIG. 2 is a sectional view showing a coil component.
Figure 3:
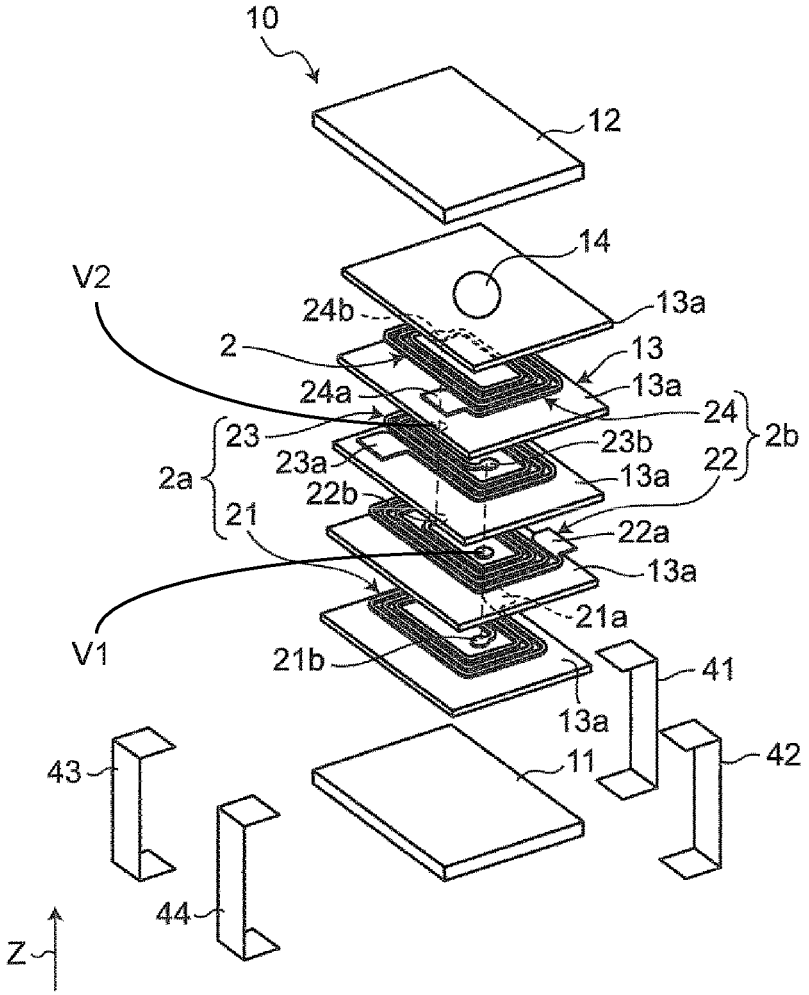
FIG. 3 is an exploded perspective view showing a coil component.

FIG. 1 is a perspective view showing a coil component 10 according to a first embodiment of the present disclosure. FIG. 2 is a sectional view showing the coil component 10. FIG. 3 is an exploded perspective view showing the coil component 10. As shown in FIG. 1, FIG. 2, and FIG. 3, a coil component 10 includes a multilayer body 1, a coil 2 disposed in the multilayer body 1, and first to fourth outer electrodes 41 to 44 disposed on the multilayer body 1.

The coil component 10 is a common mode choke coil. The coil component 10 may be in electronic equipment, e.g., a personal computer, a DVD player, a digital camera, a TV, a cellular phone, and car electronics.

The multilayer body 1 includes a first magnetic body 11, an insulator 13 stacked on the first magnetic body 11, a second magnetic body 12 stacked on the insulator 13, and an internal magnetic body 14 disposed in the insulator 13. The stacking direction of the first magnetic body 11, the insulator 13, and the second magnetic body 12 is the Z-direction indicated by an arrow. The first magnetic body 11 is located at a lower position, and the second magnetic body 12 is located at an upper position.

The first magnetic body 11, the internal magnetic body 14, and the second magnetic body 12 are composed of, for example, Ni—Cu—Zn-based ferrite, providing favorable high-frequency impedance characteristics. The insulator 13 is composed of, for example, glass containing borosilicate glass, the dielectric constant can be decreased, the stray capacitance of the coil 2 can be reduced, and favorable high-frequency characteristics can be provided. The insulator 13 is formed by stacking a plurality of insulating layers 13*a* on each other.

The multilayer body 1 is formed so as to have a shape of a substantially rectangular parallelepiped. The surface of the multilayer body 1 includes a first end surface 111, a second end surface 112, a first side surface 115, a second side surface 116, a third side surface 117, and a fourth side surface 118. The first end surface 111 and the second end surface 112 are located at opposing positions in the stacking direction (Z-direction). The first to fourth side surfaces 115 to 118 are located at positions between the first end surface 111 and the second end surface 112. The first end surface 111 is located at a lower position, and the second end surface 112 is located at an upper position.

The coil 2 includes a primary coil 2*a* and a secondary coil 2*b* magnetically coupled to each other. The primary coil 2*a* and the secondary coil 2*b* are disposed in the insulator 13 and arranged in the stacking direction.

The primary coil 2*a* includes a first coil conductor layer 21 and a third coil conductor layer 23 electrically connected to each other. The secondary coil 2*b* includes a second coil conductor layer 22 and a fourth coil conductor layer 24 electrically connected to each other.

The first to fourth coil conductor layers 21 to 24 are arranged sequentially in the stacking direction. That is, two coil conductor layers 21 and 23 of the primary coil 2*a* and two coil conductor layers 22 and 24 of the secondary coil 2*b* are arranged alternately in the stacking direction. The first to fourth coil conductor layers 21 to 24 are disposed on the respective insulating layers 13*a* different from each other. The first to fourth coil conductor layers 21 to 24 are composed of an electrically conductive material, for example, Ag, Cu, Au, or Ni, or an alloy containing any one of the metals as a primary component.

The first to fourth coil conductor layers 21 to 24 have a spiral pattern and are spiral windings on a plane when viewed from above. The center axes of each of the first to fourth coil conductor layers 21 to 24 are in accord with each other when viewed from above. All the coil conductor layers are stacked one on another in the stacking direction. However, the center axis of at least one coil conductor layer 21 to 24 may be different from the center axes of the other coil conductor layers 21 to 24 when viewed from above. That is, at least one coil conductor layer 21 to 24 may be shifted from the other coil conductor layers 21 to 24 when viewed in the stacking direction.

A first end 21*a* of the first coil conductor layer 21 extends to the outer circumference, and a second end 21*b* of the first coil conductor layer 21 is located at the inner circumference. Likewise, the second coil conductor layer 22 has a first end 22*a* and a second end 22*b*, the third coil conductor layer 23 has a first end 23*a* and a second end 23*b*, and the fourth coil conductor layer 24 has a first end 24*a* and a second end 24*b*.

The first end 21*a* of the first coil conductor layer 21 is exposed at the second side surface 116 at a position close to the first side surface 115. The first end 22*a* of the second coil conductor layer 22 is exposed at the second side surface 116 at the position close to the third side surface 117. The first end 23*a* of the third coil conductor layer 23 is exposed at the fourth side surface 118 at the position close to the first side surface 115. The first end 24*a* of the fourth coil conductor layer 24 is exposed at the fourth side surface 118 at the position close to the third side surface 117.

The second end 21*b* of the first coil conductor layer 21 is electrically connected to the second end 23*b* of the third coil conductor layer 23 via the via conductor V1, which passes through the insulating layer 13*a* that is interposed therebetween. Likewise, the second end 22*b* of the second coil conductor layer 22 is electrically connected to the second end 24*b* of the fourth coil conductor layer 24 via the via conductor V2, which passes through the insulating layer 13*a* that is interposed therebetween.

The first to fourth outer electrodes 41 to 44 are composed of an electrically conductive material, for example, Ag, Ag—Pd, Cu, or Ni. The first to fourth outer electrodes 41 to 44 are formed by, for example, coating the surface of the multilayer body 1 with the electrically conductive material and performing baking. Each of the first to fourth outer electrodes 41 to 44 is formed into a substantially U shape.

The first outer electrode 41 is disposed on the second side surface 116 at the position close to the first side surface 115. One end portion of the first outer electrode 41 that extends from the second side surface 116 is disposed on the first end surface 111 by bending, and the other end portion of the first outer electrode 41 that extends from the second side surface 116 is disposed on the second end surface 112 by bending. The first outer electrode 41 is electrically connected to the first end 21*a* of the first coil conductor layer 21.

Likewise, the second outer electrode 42 is disposed on the second side surface 116 at the position close to the third side surface 117 and is electrically connected to the first end 22*a* of the second coil conductor layer 22. The third outer electrode 43 is disposed on the fourth side surface 118 at the position close to the first side surface 115 and is electrically connected to the first end 23*a* of the third coil conductor layer 23. The fourth outer electrode 44 is disposed on the fourth side surface 118 at the position close to the third side surface 117 and is electrically connected to the first end 24*a* of the fourth coil conductor layer 24.

Figure 4:
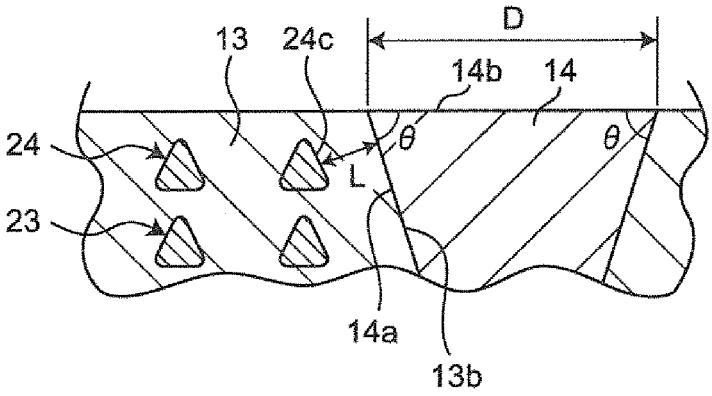
FIG. 4 is a diagram showing a magnified part of FIG. 2.

FIG. 4 is a diagram showing a magnified part of FIG. 2. As shown in FIG. 2 and FIG. 4, the internal magnetic body 14 is disposed within the inner circumference of the coil 2 in the insulator 13 and is connected to the first magnetic body 11 and the second magnetic body 12. In a cross section in the stacking direction, the width of the internal magnetic body 14 increases continuously from the first magnetic body 11 side toward the second magnetic body 12 side.

Specifically, a hole 13*b* that passes through the insulator 13 in the stacking direction is located within the inner circumference of the coil 2. The internal magnetic body 14 is disposed in the hole 13*b*. The inner diameter of the hole 13*b* increases continuously from the first magnetic body 11 side toward the second magnetic body 12 side.

An end coil conductor layer located closest to the second magnetic body 12, in the coil 2, is the fourth coil conductor layer 24. In a cross section in the stacking direction, the inner circumferential surface 24*c* of the fourth coil conductor layer 24 faces the outer circumferential surface 14*a* of the internal magnetic body 14 and is inclined in the same direction as the outer circumferential surface 14*a* of the internal magnetic body 14 with respect to the stacking direction. The inner circumferential surface 24*c* of the fourth coil conductor layer 24 and the outer circumferential surface 14*a* of the internal magnetic body 14 are flat surfaces but may be curved surfaces.

As described above, the inner circumferential surface 24*c* of the fourth coil conductor layer 24 faces the outer circumferential surface 14*a* of the internal magnetic body 14 and is inclined in the same direction as the outer circumferential surface 14*a* of the internal magnetic body 14 with respect to the stacking direction. Therefore, the inner circumferential surface 24*c* of the fourth coil conductor layer 24 can be set away from the outer circumferential surface 14*a* of the internal magnetic body 14 compared with the case where the inner circumferential surface 24*c* of the fourth coil conductor layer 24 is parallel to the stacking direction.

Consequently, when the hole 13*b* is formed from the second magnetic body 12 side toward the first magnetic body 11 side in the insulator 13 so as to be filled with the internal magnetic body 14, stress concentration on the insulator 13 around the inner circumferential surface 24*c* of the fourth coil conductor layer 24 can be reduced, and the occurrence of cracks in the insulator 13 can be suppressed. In short, the fourth coil conductor layer 24 is noted because of being closest to the outer circumferential surface 14*a* of the internal magnetic body 14, and the inner circumferential surface 24*c* of the fourth coil conductor layer 24 is set to be inclined in the same direction as the outer circumferential surface 14*a* of the internal magnetic body 14 such that not only the ridge portion of the fourth coil conductor layer 24 are located at positions a minimal distance from the outer circumferential surface 14*a* of the internal magnetic body 14. Consequently, stress concentration on only the vertices of the fourth coil conductor layer 24 and in the vicinity thereof is suppressed.

Figure 5:
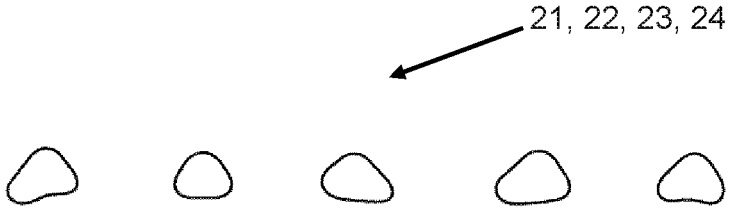
FIG. 5 is a schematic diagram showing a plurality of coil conductor layers.

As shown in FIG. 2 and FIG. 4, in the cross section in the stacking direction, each shape of the first to fourth coil conductor layers 21 to 24 is substantially polygonal and has round vertices. Specifically, each shape of the first to fourth coil conductor layers 21 to 24 is substantially triangular and protrudes toward the second magnetic body 12 side. FIG. 5 is a schematic diagram showing a plurality of coil conductor layers, such as any of coil conductor layers 21 to 24, the diagram being drawn on the basis of the images observed by an optical microscope. The shapes of actual coil conductor layers 21 to 24 are various shapes shown in, for example, FIG. 5, and "substantially triangular" includes these shapes.

The shape of the fourth coil conductor layer 24 is substantially polygonal and has round vertices. Therefore, stress concentration on the insulator 13 around the vertices of the fourth coil conductor layer 24 can be reduced, and the occurrence of cracks in the insulator 13 can be suppressed. In addition, the cross-sectional shape of the fourth coil conductor layer 24 is substantially triangular and protrudes toward the second magnetic body 12 side. Therefore, delamination between insulating layers that interpose the coil conductor layer 24 can be suppressed.

As shown in FIG. 2 and FIG. 4, the end surface 14*b* of the internal magnetic body 14 that faces the second magnetic body 12 is substantially circular, and the diameter D of the end surface 14*b* is preferably about 200 μm or less. In a cross section in the stacking direction, the angle θ formed by the end surface 14*b* and the outer circumferential surface 14*a* of the internal magnetic body 14 is preferably about 45 degrees or more and 70 degrees or less (i.e., from about 45 degrees to 70 degrees). Consequently, the volume of the internal magnetic body 14 is ensured, high impedance is gained, and the coil 2 can be arranged in the inner part of the insulator 13 so as to increase the number of turns of the coil 2. In this regard, when the outer circumferential surface 14*a* of the internal magnetic body 14 is a curved surface, the angle θ formed by the end surface 14*b* and a tangent plane at an intersection point of the outer circumferential surface 14*a* and the end surface 14*b* is about 45 degrees or more and 70 degrees or less (i.e., from about 45 degrees to 70 degrees).

As shown in FIG. 4, in a cross section in the stacking direction, the inner circumferential surface 24*c* of the fourth coil conductor layer 24 is preferably along the outer circumferential surface 14*a* of the internal magnetic body 14, and further preferably parallel to the outer circumferential surface 14*a* of the internal magnetic body 14. Accordingly, the inner circumferential surface 24*c* of the fourth coil conductor layer 24 can be reliably set away from the outer circumferential surface 14*a* of the internal magnetic body 14, and the occurrence of cracks in the insulator 13 can be suppressed.

When the inner circumferential surface 24*c* of the fourth coil conductor layer 24 and the outer circumferential surface 14*a* of the internal magnetic body 14 are curved surfaces, regarding a straight line that intersects the inner circumferential surface 24*c* of the fourth coil conductor layer 24 and the outer circumferential surface 14*a* of the internal magnetic body 14 with a minimal distance, a tangent plane at an intersection point of the inner circumferential surface 24*c* of the fourth coil conductor layer 24 and the straight line is parallel to a tangent plane at an intersection point of the outer circumferential surface 14*a* of the internal magnetic body 14 and the straight line.

As shown in FIG. 4, in a cross section in the stacking direction, the minimal distance L between the inner circumferential surface 24*c* of the fourth coil conductor layer 24 and the outer circumferential surface 14*c* of the internal magnetic body 14 is preferably about 100 μm or more. The inner circumferential surface 24*c* of the fourth coil conductor layer 24, in the coil 2, is closest to the outer circumferential surface 14*a* of the internal magnetic body 14. Consequently, the thickness of the insulator 13 in this portion is the smallest in the insulator 13, and the strength itself against the stress is reduced. The minimal distance between the inner circumferential surface 24*c* of the fourth coil conductor layer 24 and the outer circumferential surface 14*a* of the internal magnetic body 14 is about 100 μm or more and, therefore, the insulator 13 can ensure strength sufficient for enduring thermal stress during baking of outer electrodes 41 to 44 and mounting.

Next, a method for manufacturing the coil component 10 will be described.

As shown in FIG. 2 and FIG. 3, a plurality of insulating layers 13*a* provided with the respective coil conductor layers 21 to 24 are stacked sequentially on the first magnetic body 11. As a result, the insulator 13 in which the coil 2 is disposed is stacked on the first magnetic body 11.

Thereafter, a laser is applied from above the insulator 13 downward so as to form a hole 13*b* that vertically passes through the insulator 13. The hole 13*b* may be formed by mechanical processing other than the laser.

Subsequently, the resulting hole 13*b* is filled with the internal magnetic body 14, and the second magnetic body 12 is stacked on the insulator 13 so as to form the multilayer body 1. Then, the multilayer body 1 is fired, and the outer electrodes 41 to 44 are formed on the multilayer body 1 so as to produce the coil component 10.

Second Embodiment

Figure 6:
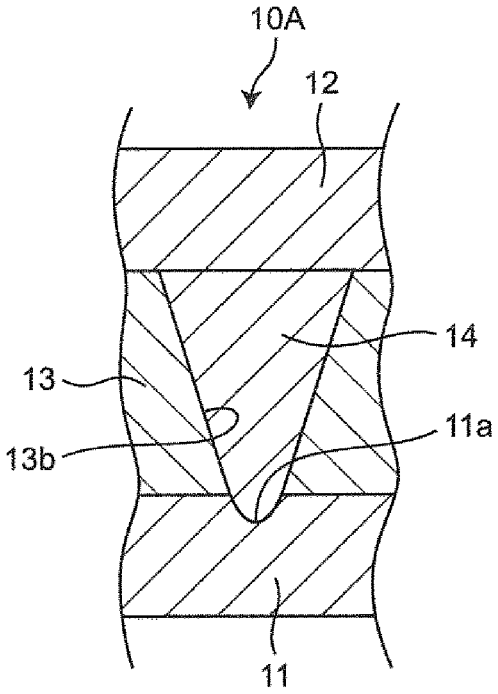
FIG. 6 is a sectional view showing a coil component according to a second embodiment of the present disclosure.

FIG. 6 is a sectional view showing a coil component 10A according to a second embodiment of the present disclosure. The second embodiment is different from the first embodiment in the configuration of the first magnetic body 11. The difference in the configuration will be described below. Other configurations are the same as the configurations in the first embodiment and indicated by the same reference numerals as those in the first embodiment, and explanations thereof will not be provided.

In a coil component 10A according to the second embodiment, as shown in FIG. 6, a first magnetic body 11 has a recessed portion 11*a* connected to an internal magnetic body 14. That is, the recessed portion 11*a* in the first magnetic body 11 communicates with the hole 13*b* in the insulator 13. The internal magnetic body 14 enters the recessed portion 11*a* in the first magnetic body 11.

Therefore, the internal magnetic body 14 comes into contact with the recessed portion 11*a* in the first magnetic body 11, and the contact area between the first magnetic body 11 and the internal magnetic body 14 can be increased. Consequently, a magnetic path can be reliably ensured, high impedance is gained, and variations in the impedance can be reduced.

When the hole 13*b* to be filled with the internal magnetic body 14 is formed in the insulator 13, the hole 13*b* that passes through the insulator 13 can be reliably formed by forming the hole 13*b* such that the recessed portion 11*a* can be formed in the first magnetic body 11. Consequently, the internal magnetic body 14 can be reliably connected to the first magnetic body 11, and a magnetic path can be reliably ensured.

Third Embodiment

Figure 7:
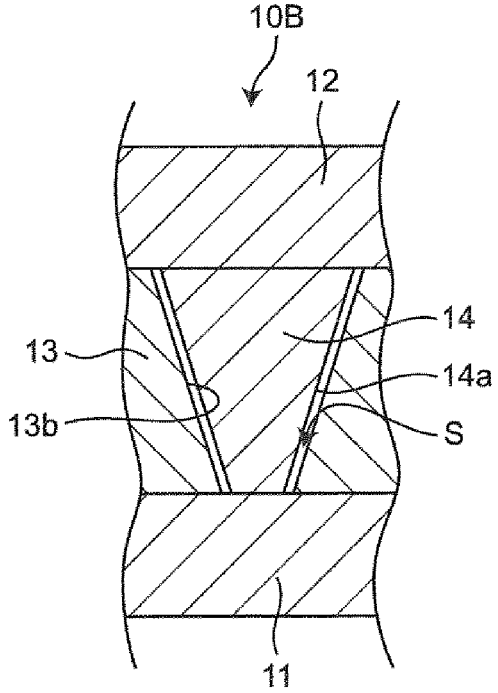
FIG. 7 is a sectional view showing a coil component according to a third embodiment of the present disclosure.

FIG. 7 is a sectional view showing a coil component 10B according to a third embodiment of the present disclosure. The third embodiment is different from the first embodiment in the configuration of the interface between the internal magnetic body and the insulator 13. The difference in the configuration will be described below. Other configurations are the same as the configurations in the first embodiment and indicated by the same reference numerals as those in the first embodiment, and explanations thereof will not be provided.

In a coil component 10B according to the third embodiment, as shown in FIG. 7, a gap S is present at the interface between the internal magnetic body 14 and the insulator 13. That is, the gap S is located between the outer circumferential surface 14*a* of the internal magnetic body 14 and the inner surface of the hole 13*b* in the insulator 13. The gap S is located over the entire circumference of the interface between the internal magnetic body 14 and the insulator 13 but may be formed in at least part of the interface between the internal magnetic body 14 and the insulator 13.

The gap S is present in the interface between the internal magnetic body 14 and the insulator 13. Therefore, even when there is a difference in the thermal expansion coefficient between the internal magnetic body 14 and the insulator 13, stress applied from the internal magnetic body 14 to the insulator 13 after firing can be reduced, and the occurrence of cracks in the insulator 13 can be suppressed. In addition, a reduction in magnetic permeability (magnetostriction) of the internal magnetic body 14 is suppressed, and high impedance can be gained.

EXAMPLE

Next, an example of the first embodiment will be described.

The coil conductor layer 21 to 24 is formed by plating in which a resist is used such that a cross-sectional shape becomes a substantially mushroom-like shape. More specifically, a support substrate having electrical conductivity is prepared, a resist is formed on a portion of the support substrate excluding a transfer region that has a predetermined pattern, and a plating electrode having a thickness larger than the thickness of the resist is formed in the transfer region. In this case, the plating electrode protrudes from the upper surface of the resist and, as a result, the cross section has a substantially mushroom-like shape. To facilitate peeling of the coil conductor layer 21 to 24 from the resist, preferably, the resist is tapered such that the cavity increases from the lower side toward the upper side in the height direction. The coil conductor layer 21 to 24 is primarily composed of Ag and may contain oxides, e.g., $Al_2O_3$ and $SiO_2$, as additives.

Meanwhile, magnetic layers and insulating layers composed of Ni—Cu—Zn-based ferrite, alkali borosilicate glass, a composite material of alkali borosilicate glass and Ni—Cu—Zn-based ferrite, or the like are prepared. Via holes that connect between the coils are formed in the insulating layers and filled with an electrically conductive material containing Ag.

Thereafter, the coil conductor layer 21 to 24 formed by plating is transferred to the insulating layer so as to prepare a sheet provided with the coil conductor layer 21 to 24. The coil conductor layer 21 to 24 is transferred in reverse and, thereby, has a substantially mushroom-like shape that protrudes upward.

After the magnetic layers are stacked, a predetermined numbers of insulating layers, to which the coil conductor layers 21 to 24 have been transferred, are stacked on the magnetic layers. Subsequently, a hole is formed within the inner circumference of the coil conductor layer 21 to 24 by a laser. The taper angle of the hole is set to be about 45 degrees or more and 70 degrees or less (i.e., from about 45 degrees to 70 degrees) and, as a result, processing can be performed with laser energy that does not pass through the lower magnetic layer even when a hole that passes through the insulating layer having a thickness of about 80 μm or more is formed.

If the minimal distance between the inner circumferential portion of the coil conductor layer 21 to 24 and the laser hole is excessively small, fine cracks occur in the insulator 13 (insulating layer) around the coil conductor layer 21 to 24 due to energy during laser processing. Therefore, the distance is preferably about 100 μm or more. The same applies to a land portion for via connection in addition to the inner circumferential portion of the coil conductor layer 21 to 24. The hole may be formed by sandblast treatment or the like.

Thereafter, the resulting hole is filled with a magnetic paste so as to form an internal magnetic body 14 that protrudes downward. The magnetic layers are successively stacked so as to produce a multilayer body. The multilayer body is pressure-bonded by a method of isostatic press or the like and is cut so as to produce a chip-like multilayer body.

When the chip-like multilayer body is fired at about 870° C. to 910° C., glass in the insulator 13 is sufficiently softened and tends to become spherical due to surface tension. Meanwhile, tensile stress is applied to the coil conductor layer 21 to 24 in the direction toward the center due to sintering and, thereby, the vertices of the coil conductor layer 21 to 24 are rounded in accordance with the stress relationship between the insulator 13 and the coil conductor layer 21 to 24. As a result, the shape of the coil conductor layer 21 to 24 becomes a substantially triangular shape with round vertices from a substantially mushroom-like shape that protrudes upward. A round electrode may be formed by reducing the electrode dimension that protrudes from the resist.

A state, in which sintering of the internal magnetic body 14 is facilitated while shrinkage due to softening of glass is suppressed and shrinkage becomes significant, can be produced by decreasing the firing temperature to about 870° C. and controlling the firing atmosphere so as to form a gap (gap S in the third embodiment) between the glass (insulator) and the internal magnetic body 14. In addition, the stress applied to the internal magnetic body 14 can be reduced and, thereby, cracks do not easily occur in the internal magnetic body 14. It is preferable that the pore area percentages of the internal magnetic body 14 and the first and second magnetic bodies be about 15% or less and the pore diameter be about 1.5 μm or less.

The pore diameter and the pore area percentage were measured as described below.

A portion of the internal magnetic body 14, the first magnetic body 11, or the second magnetic body 12 in a cross section of the coil component 10 (refer to FIG. 2) was mirror-polished and was subjected to focused ion beam micromachining (FIB micromachining) (FIB apparatus: FIB200TEM produced by FEI). Thereafter, observation was performed by a scanning electron microscope (FE-SEM: JSM-7500FA produced by JEOL LTD.), and the pore diameter and the pore area percentage were measured. These were calculated by using image processing software (WINROOF Ver. 5.6 produced by MITANI CORPORATION).

The conditions for the focused ion beam micromachining and observation by FE-SEM were as described below.

Focused ion beam micromachining (FIB micromachining) condition

A polished surface of the mirror-polished sample was subjected to FIB micromachining at an incident angle of 5°.

Scanning electron microscope (SEM) observation conditions

Acceleration voltage: 15 kV

Sample inclination: 85°

Signal: secondary electron

Coating: Pt

Magnification: 20,000 times

The pore diameter and the pore area percentage were determined by the following method in which image processing software was used.

The measurement range of the image was specified as about 15 μm×15 μm. The image obtained by FE-SEM was subjected to binarization and only pores were extracted. The area of each pore was measured, each pore measured was assumed to be a perfect circle, and the diameter thereof was calculated and taken as the pore diameter. The area of the measurement range and the pore area were calculated by using a "Total area·Number measurement" function of the image processing software, and the proportion of the pore area per area of the measurement range (pore area percentage) was determined.

Burrs were removed by barreling the chip after firing. Outer electrodes 41 to 44 were formed by being applied and baked. Subsequently, the outer electrodes 41 to 44 were subjected to plating of Ni, Cu, Sn, or the like. After the plating, the surface was coated with a silane-coupling-based water-repellent agent to prevent reduction in insulation resistance between the outer electrodes 41 to 44 under the influence of moisture and impurities in the atmosphere.

According to the above-described example, regarding the coil conductor layer 21 to 24 formed by plating, the cross section of the coil conductor layer 21 to 24 after firing can be made to have a shape with round vertices or a substantially triangular shape with round vertices by controlling the height and the taper of the resist and/or the height of the plating electrode that protrudes from the resist.

When ferrite is used for the magnetic layer and glass is used for the insulating layer, favorable high-frequency characteristics can be provided. When the taper angle of the internal magnetic body 14 is set to be about 45 degrees to 70 degrees, a thick magnetic path can be formed, the impedance can be high, and variations in the impedance can be reduced. When the firing process is controlled, it is possible to form a gap between the internal magnetic body 14 and the insulator 13 (glass) so as to reduce the stress applied to the internal magnetic body 14.

When the internal magnetic body 14 approaches the inner circumference of the coil conductor layer 21 to 24, the size of the insulator 13 between the internal magnetic body 14 and the inner circumference of the coil conductor layer 21 to 24 is reduced. The strength itself is reduced and, as a result, cracks easily occur due to thermal stress. However, the strength can be ensured by setting the dimension between the internal magnetic body 14 and the inner circumference of the coil conductor layer 21 to 24 to be about 100 μm or more.

In this regard, the present disclosure is not limited to the above-described embodiments, and the design can be changed within the bounds of not departing from the gist of the present disclosure. For example, the feature of each of the first to third embodiments may be variously combined.

In the above-described embodiments, each of the primary coil 2*a* and the secondary coil 2*b* is composed of two coils. However, at least one of the primary coil 2*a* and the secondary coil 2*b* may be composed of one coil or three or more coils.

In the above-described embodiments, the common mode choke coil is used as the coil component 10, 10A and 10B. However, a single coil may be used. The coil has only to include at least one coil conductor layer 21 to 24.

In the above-described embodiments, the shape of the coil conductor layer 21 to 24 is substantially triangular but may be substantially polygonal other than triangular. The shape of the coil conductor layer 21 to 24 is substantially polygonal and has round vertices but may be substantially polygonal and have vertices with acute angles. The shape of the end surface that faces the second magnetic body 12 is substantially circular but may be substantially elliptical or polygonal.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a first magnetic body;

an insulator stacked on the first magnetic body;

a second magnetic body stacked on the insulator;

a coil which is disposed in the insulator and includes at least one coil conductor layer; and an internal magnetic body which is disposed within an inner circumference of the coil in the insulator and is connected to the first magnetic body and the second magnetic body, wherein, in a cross section in a stacking direction of the first magnetic body, the insulator, and the second magnetic body, a width of the internal magnetic body increases continuously from the first magnetic body side toward the second magnetic body side, and an inner circumferential surface of an end coil conductor layer located closest to the second magnetic body, in the coil, faces an outer circumferential surface of the internal magnetic body and is inclined in a same direction as the outer circumferential surface of the internal magnetic body with respect to the stacking direction.

2. The coil component according to claim 1, wherein, in a cross section in the stacking direction, a shape of the end coil conductor layer is polygonal and has round vertices.

3. The coil component according to claim 2, wherein the shape of the end coil conductor layer is triangular and protrudes toward the second magnetic body.

4. The coil component according to claim 3, wherein the first magnetic body, the internal magnetic body, and the second magnetic body are composed of Ni—Cu—Zn-based ferrite, and the insulator is composed of glass containing borosilicate glass.

5. The coil component according to claim 3, wherein:

an end surface of the internal magnetic body that faces the second magnetic body is circular and has a diameter of 200 μm or less, and in a cross section in the stacking direction, an angle formed by the end surface and the outer circumferential surface of the internal magnetic body is from 45 degrees to 70 degrees.

6. The coil component according to claim 3, wherein, in a cross section in the stacking direction, the inner circumferential surface of the end coil conductor layer is parallel to the outer circumferential surface of the internal magnetic body.

7. The coil component according to claim 3, wherein the first magnetic body has a recessed portion connected to the internal magnetic body.

8. The coil component according to claim 3, wherein a gap is present in at least part of an interface between the internal magnetic body and the insulator.

9. The coil component according to claim 2, wherein the first magnetic body, the internal magnetic body, and the second magnetic body are composed of Ni—Cu—Zn-based ferrite, and the insulator is composed of glass containing borosilicate glass.

10. The coil component according to claim 2, wherein:

an end surface of the internal magnetic body that faces the second magnetic body is circular and has a diameter of 200 μm or less, and in a cross section in the stacking direction, an angle formed by the end surface and the outer circumferential surface of the internal magnetic body is from 45 degrees to 70 degrees.

11. The coil component according to claim 2, wherein, in a cross section in the stacking direction, the inner circumferential surface of the end coil conductor layer is parallel to the outer circumferential surface of the internal magnetic body.

12. The coil component according to claim 2, wherein the first magnetic body has a recessed portion connected to the internal magnetic body.

13. The coil component according to claim 2, wherein a gap is present in at least part of an interface between the internal magnetic body and the insulator.

14. The coil component according to claim 2, wherein, in a cross section in the stacking direction, a minimal distance between the inner circumferential surface of the end coil conductor layer and the outer circumferential surface of the internal magnetic body is 100 μm or more.

15. The coil component according to claim 1, wherein the first magnetic body, the internal magnetic body, and the second magnetic body are composed of Ni—Cu—Zn-based ferrite, and the insulator is composed of glass containing borosilicate glass.

16. The coil component according to claim 1, wherein:

an end surface of the internal magnetic body that faces the second magnetic body is circular and has a diameter of 200 μm or less, and in a cross section in the stacking direction, an angle formed by the end surface and the outer circumferential surface of the internal magnetic body is from 45 degrees to 70 degrees.

17. The coil component according to claim 1, wherein, in a cross section in the stacking direction, the inner circumferential surface of the end coil conductor layer is parallel to the outer circumferential surface of the internal magnetic body.

18. The coil component according to claim 1, wherein the first magnetic body has a recessed portion connected to the internal magnetic body.

19. The coil component according to claim 1, wherein a gap is present in at least part of an interface between the internal magnetic body and the insulator.

20. The coil component according to claim 1, wherein, in a cross section in the stacking direction, a minimal distance between the inner circumferential surface of the end coil conductor layer and the outer circumferential surface of the internal magnetic body is 100 μm or more.

* * * * *